US006101817A

United States Patent [19]

Watt

[11] Patent Number: 6,101,817

[45] Date of Patent: Aug. 15, 2000

[54] METHOD AND APPARATUS FOR CONTINUOUSLY EXTRUDING ICE

[76] Inventor: John R. Watt, Lenbrook Sq. 3747 Peachtree Rd. NE., Atlanta, Ga. 30319

[21] Appl. No.: 09/286,958

[22] Filed: Apr. 6, 1999

[51] Int. Cl.[7] ..... F25C 1/12

[52] U.S. Cl. ..... 62/71; 62/353

[58] Field of Search ..... 62/71, 353, 66, 62/340

[56] References Cited

U.S. PATENT DOCUMENTS

| | | | |
|---|---|---|---|
| 2,071,465 | 2/1937 | Huber | 62/356 |
| 2,374,997 | 5/1945 | Hill | 62/356 |
| 2,471,655 | 5/1949 | Rundell | 62/356 |
| 2,542,891 | 2/1951 | Bayston | 62/356 |
| 2,571,506 | 10/1951 | Watt | 62/356 |
| 2,639,594 | 5/1953 | Watt | 62/356 |

*Primary Examiner*—William E. Tapolcal
*Attorney, Agent, or Firm*—Morris, Manning & Martin, L.L.P.

[57] ABSTRACT

Apparatus to form and maintain a vent between the top and bottom surfaces of an ice core formed by ice extruders is disclosed. The vent is initially formed in one embodiment by a hollow member suspended within the freezing cell of the apparatus with one end of the hollow member forming a seal with a projection on the plunger that lifts the ice core upward during the extrusion of ice. After the vent is initially formed, the hollow member is removed and the plunger and projection begin a reciprocating motion causing the plunger to scrape ice from the walls below the ice core. The continuing motion of the plunger presses the ice chips against the bottom of the ice core and simultaneously causes the projection to seal the bottom opening of the vent, thus preventing the ice chips from closing the vent. The vent allows air released from ice that is scrapped and pressed against the ice core to exhaust instead of forming air pockets within the ice core, which would weaken its material structure, and eventually lead to the ice core breaking into a plurality of irregular prisms.

A carrier for the ice core created using the method and apparatus of the invention is also provided. The carrier is inserted into the vent and uses one-way cammed barbs to engage the ice core. A rod is provided in the carrier that when pressed disengages the cammed barbs from the ice core.

24 Claims, 8 Drawing Sheets

METHOD AND APPARATUS FOR CONTINUOUSLY EXTRUDING ICE

FIELD OF THE INVENTION

The invention relates generally to machines that produce ice, and more particularly, to machines that extrude columns of ice from a block of ice.

BACKGROUND OF THE INVENTION

Continuous freezing machines are used to extrude hard ice in a symmetric column that is easily cut, packed, stored and transported. Continuous freezing machines are described generally in U.S. Pat. No. 2,571,506 (Watt I) and U.S. Pat. No. 2,639,594 (Watt II) as well as U.S. Pat. No. 2,071,465 (Huber), U.S. Pat. No. 2,374,997 (Hill), U.S. Pat. No. 2,471,655 (Rundell) and U.S. Pat. No. 2,542,891 (Bayston), all of which are incorporated herein by reference.

FIG. 1 shows a known continuous freezing machine 10. In general, a freezing cell 12, shown as a vertically tapered, externally refrigerated open ended frusto-conical cylinder, is mounted within a reservoir 14 of cooled water 16. The major end 18 of freezing cell 12 is above reservoir 14 with minor end 20 of freezing cell 12 submerged below the water line 22 of reservoir 14. A stub cylinder 24 connects to minor end 20. A motor 26 forces a ram 28 and plunger 30 to vertically reciprocate within stub cylinder 24.

Operation of freezing machine 10 begins by placing ram 28 and plunger 30 in their "at-rest" position at the bottom of stub cylinder 24. Water is introduced to freezing cell 12 by pump 32. Refrigerated inner wall 34 of freezing cell 12 chills the water until a solid ice core 36 begins to form at minor end 20. The formation of ice core 36 chills unrefrigerated inner wall 38 of stub cylinder 24 leading to the formation of an ice sleeve 40 on inner wall 38.

When ice sleeve 40 reaches a predetermined thickness (typically ⅜" or ½"), motor 26 is activated to drive ram 28. As a result, plunger 30 scrapes inner wall 38 and breaks up ice sleeve 40 as it moves upward in stub cylinder 24, eventually compacting the resulting ice chips against ice core 36.

Referring to FIG. 2, ram 28 continues its upward movement and breaks ice core 36 away from inner wall 34 in one piece and lifts ice core 36 slightly (approximately 0.10") creating a thin annular crevice 42 between ice core 36 and inner wall 34. Water from pool 44 above ice core 36 is drawn into and fills annular crevice 42. Ram 38 maintains its position at the top of its stroke allowing the water occupying annular crevice 42 to freeze to inner wall 34 and ice core 36. When this occurs, ram 28 and plunger 30 are no longer needed to support ice core 36 in its current position.

Ram 28 and plunger 30 then return to their "at-rest" position at the bottom of stub cylinder 24 and pause to allow the complete freezing of the water in annular crevice 42 and for a new ice sleeve 40 to form on inner wall 38. Typically, this rest lasts for approximately ten seconds. The ram action then commences again with the upward stroke of ram 28 and plunger 30.

In this fashion, continuous freezing machine 10 forms a column of hard ice conforming to the shape of inner wall 34 at major end 18. This column of hard ice may be cut into blocks that are easily stacked, stored and transported as ice core 36 advances upward past major end 18.

However, continuous freezing machines similar to that in FIGS. 1 and 2 only work efficiently in short bursts. Operation of continuous freezing machine 10 for more than a few hours at a time leads to a degradation of the symmetry of ice core 36, and eventually to the splitting of ice core 36 into a plurality of irregular prisms. Irregular prisms of ice are unmarketable as they lack the uniformity needed for efficient storing, stacking and transportation. Once irregular ice prisms form, continuous freezing machine 10 must be stopped, the ice prisms within freezing cell 12 removed, and the freezing process initiated again. This constant restarting every few hours reduces the amount of marketable ice a continuous freezing machine 10 can produce.

It would be beneficial for freezing machines to produce a uniform ice core continuously without the need for restarting due to the ice core shearing into irregular prisms without significantly increasing the cost of the freezing machine or its operation.

SUMMARY OF THE INVENTION

The limitations of previously known continuous freezing machines have been overcome by forming a vent in an ice core within the freezing cell between the top and bottom surfaces of the ice core. The continuous freezing machine includes a freezing cell in which an ice core forms, a ram and plunger mechanism for lifting the ice core in the freezing cell and a projection member on the plunger. The projection member is adapted to seal one end of the vent immediately before and during the time the ram and plunger lift the ice core.

Another aspect of the invention includes a method for forming an ice core with a vent between the ice core's top and bottom surfaces. One end of a projection member having its lower end sealed is introduced into a freezing cell. Water is next introduced into the freezing cell and around the projection member. A portion of the water within the freezing cell freezes into the beginnings of an ice core. The projection member is removed from the ice core, forming a vent in the ice core between its bottom and top surfaces.

This vent is maintained throughout the process of forming a symmetric ice core. The vent is selectively sealed immediately before and during the raising of the ice core. An annular space is created between the ice core and the freezing cell. Water is introduced into the annular space between the ice core and the freezing cell. This water is allowed to freeze. Sealing the vent prevents ice chips pressed against the ice core from closing the vent as the ice core is lifted. The vent allows air released from the ice to exhaust preventing air pockets from forming in the ice core.

The invention also includes a mechanism to simplify moving ice blocks formed by a continuous freezing machine of the invention. A specially configured carrier includes a hand grip and a shaft mounted on the hand grip substantially the same shape and diameter as the vent in the ice core. The shaft includes along the length of the shaft at its periphery a plurality of barbs adapted to allow the insertion of the carrier into the ice block but the barb prevent extraction of the carrier from the ice block. The carrier can be inserted in the vent of the ice block. The barbs will grip the ice allowing the carrier to be used to move the ice block.

An object of the invention is to provide a method to initially form a vent between the top and bottom surfaces of an ice core as it forms in a continuous freezing machine.

Still another object of the invention is to provide a method to maintain a vent between the top and bottom surfaces of an ice core as it is extruded by a continuous freezing machine.

Yet another object of the invention is to provide a device that enables ice blocks cut from an ice core to be easily moved.

These and other objects and advantages will become apparent from reading the descriptions contained herein.

DETAILED DESCRIPTION OF THE INVENTION

Figure 1:
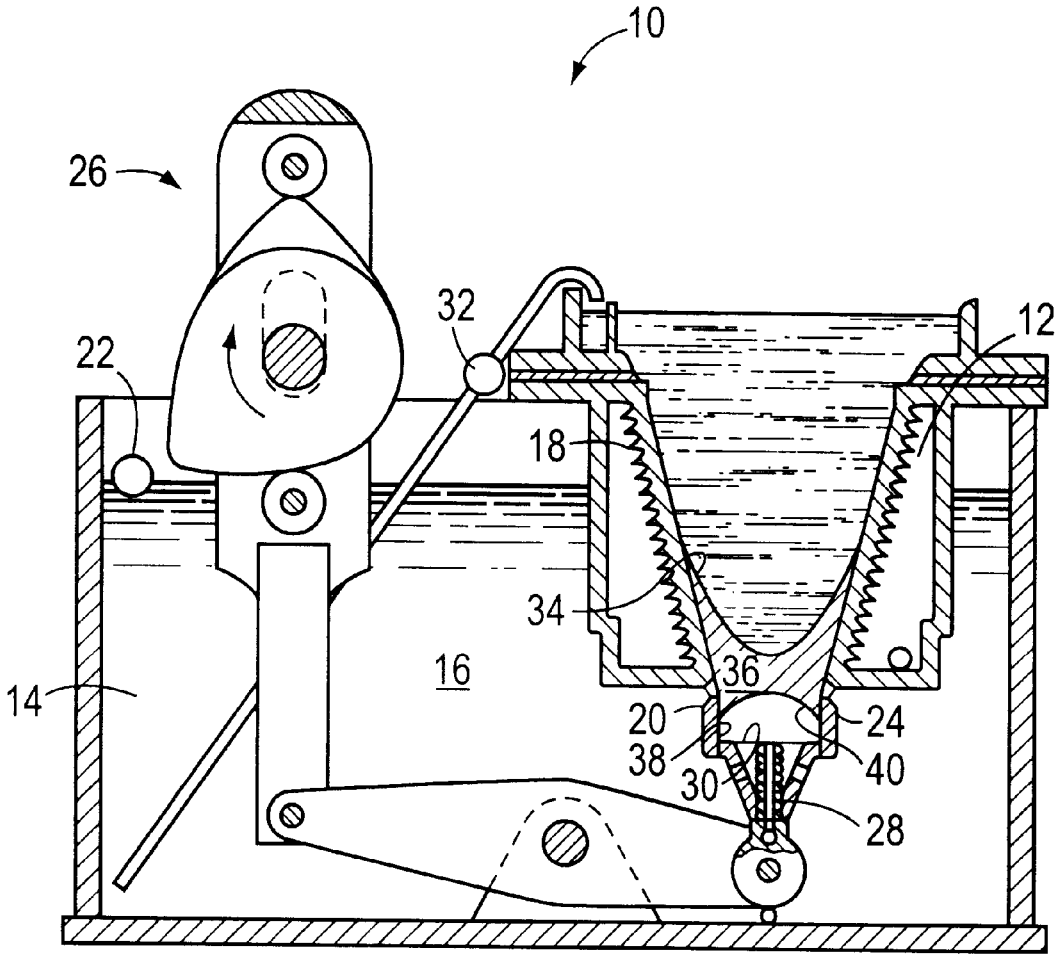
FIG. 1 PRIOR ART
FIG. 1 shows a previously known continuous freezing machine.

A detailed description of the preferred embodiment is given in connection with the accompanying drawings. It should be understood that like reference numerals are intended to identify the same structural elements, portion or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down" refer to the orientation of the illustrated structure as the particular drawing figure faces the reader. The terms "inwardly" and "outwardly" generally refer to the orientation of a surface relative to its axis of elongation, or axis of rotation, as approximate.

Figure 2:
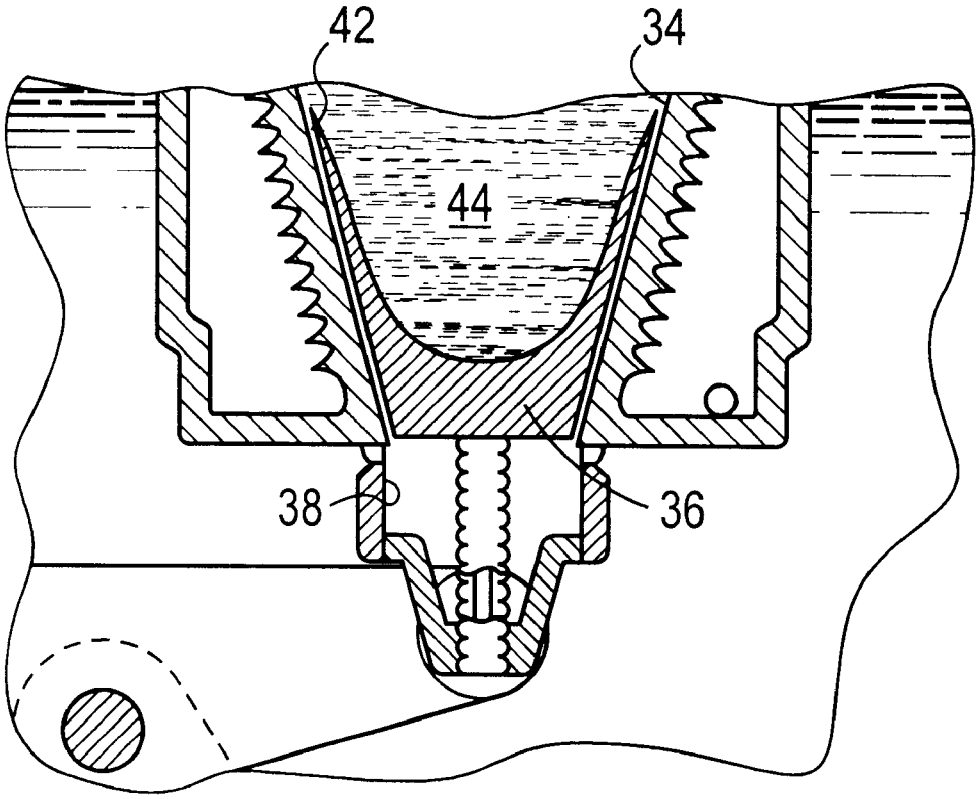
FIG. 2 PRIOR ART
FIG. 2 shows a portion of the continuous freezing machine of FIG. 1 in operation.

Known continuous freezing machines produce uniform ice cores for a relatively short time after which the ice core shears into a collection of irregular prisms that are unmarketable. This problem in previously known continuous freezing machines is caused by air that is trapped in pockets within the produced ice core, thus weakening the ice core structure. Eventually, this weakness causes the shearing of the ice core into irregular prisms. Referring to FIG. 2, the water used in the previously known continuous freezing machine 10 is saturated with air which precipitates out as tiny bubbles during freezing. These bubbles give ice core 36 a white, opaque appearance. As ram 28 and plunger 30 scrape ice sleeve 40 from inner wall 38 of stub cylinder 24 and compresses the resulting ice chips onto ice core 36, many air bubbles 44 are crushed and released. This released air collects and forms or enlarges air pockets that weaken the material structure of ice core 36. In time, the air pockets cause a radial crack to form to the center of the ice mass, ending the extrusion of a solid, uniform column.

Several possible solutions have been considered for this problem. Air pocket formation could be addressed by using distilled, air-free water. However, this increases the price of the produced ice. An air-suction inlet at the top of or adjacent to the ram could remove air the plunger releases from the ice. However, a pump coupled to the air-suction inlet would pump a slurry of air, water and ice chips, and could easily clog. A more practical solution, as provided by the present invention, is directed to the use of an air vent in the ice core allowing the released air to escape without affecting the material structure of the ice core.

Figure 3A:
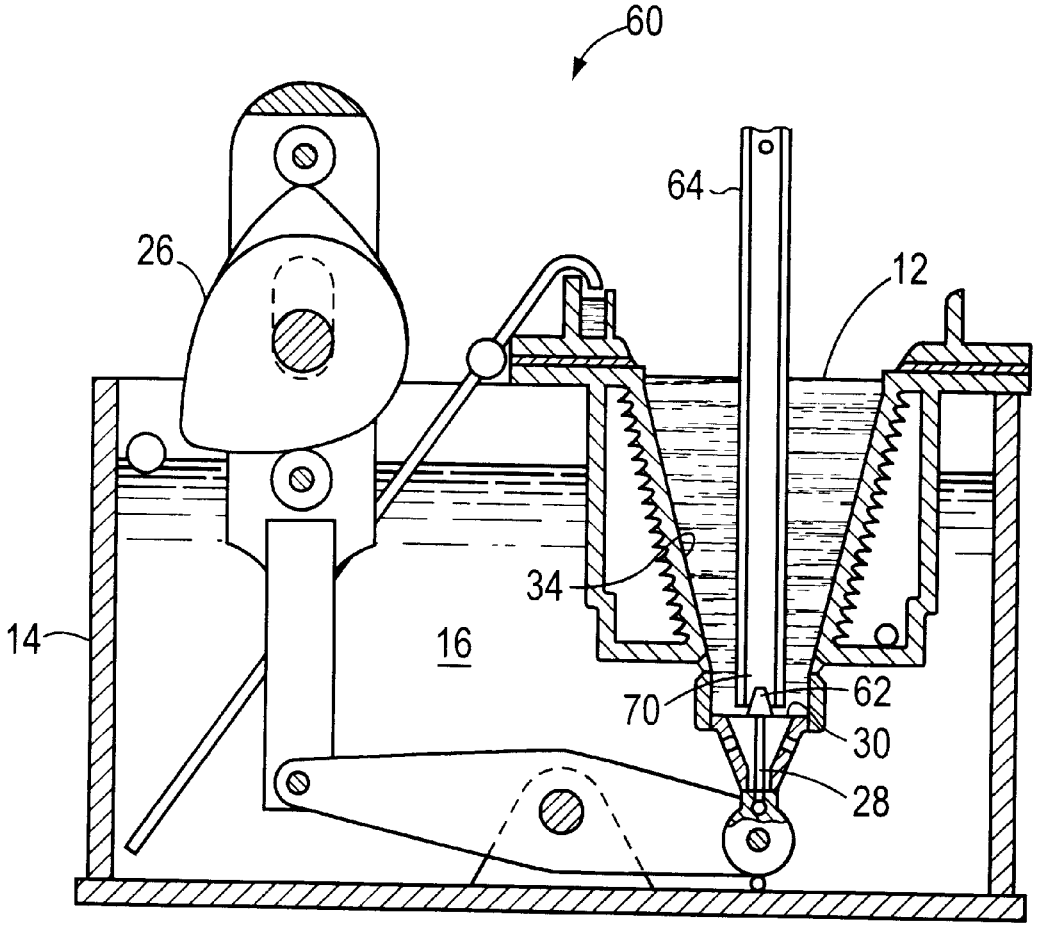
FIG. 3*a* shows a continuous freezing machine of the current invention in its initial start up state.

Referring to FIG. 3*a*, an improved continuous freezing machine 60 is shown. The primary differences between continuous freezing machine 10 and continuous freezing machine 60 are: (1) plunger 30 that includes a substantially vertical projection member 62 that is coupled to and extends up from the plunger and (2) a hollow tube 64 that is initially used in conjunction with projection 62 to form a vent in the resulting ice core 36. The vertical projection member 62 extends into the lower end of the tube 64. The diameter of the lower end of the projection member 62 is larger in size or perimeter dimension than the size of the opening in the lower end of the tube 64. By making the perimeter of the projection member 62 larger than the tube's perimeter, when the tube is placed over the projection member 62, the tube 64 comes to rest on the base or lower end of the projection member 62 to form a seal to prevent water from entering the vent formed by using the tube. The projection member 62 tapers inwardly in diameter toward the upper on top end of the projection member 62. When used together, projection member 62 and tube 64 form a vent between the bottom and top surfaces of the ice core formed. Projection member 62 thereafter maintains the integrity of the vent during operation of continuous freezing machine 60.

Preferably, the vent should be large enough to vent air bubbles yet small enough to prevent the ice core from shattering when moved. The size of the vent may vary depending on the size of the ice core to be formed and is preferably between 1.25 cm to about 2.5 cm in diameter. A vent for a freezing cell having a major end diameter that can vary between about 10 cm to over 35 cm (about 15 inches) few inches to and a minor end diameter that can vary between about 4 centimeters to about 30 centimeters.

Tube 64 may be made of a strong, smooth material having a low affinity for ice such as metal or plastic. The outer diameter of the tube is preferably between about 1.25 to about 2.5 centimeters. Tube 64 is made of a strong polyvinyl chloride (PVC). Projection member 62 may be made of any strong material having a low affinity for ice and capable of bearing the ice core without deformation or failure. Projection member 62 is preferably made of a strong noncorrosive metal such as stainless steel. The projection member 62 may be welded to the plunger 30, may be integrally molded as part of the plunger 30, or threaded into the plunger 30.

Prior to starting continuous freezing machine 60, ram 28 and plunger 30 are placed in their "at-rest" position at the bottom of stub cylinder 24 and tube 64 is positioned vertically within freezing cell 12 with its lower end 70 mated with projection member 62 to form a water proof seal at the point of connection between the projection member 62 and tube 64. The opposite end of tube 64 can be supported to maintain the tube in a vertical position. Water is then introduced into freezing cell 12.

Figure 3B:
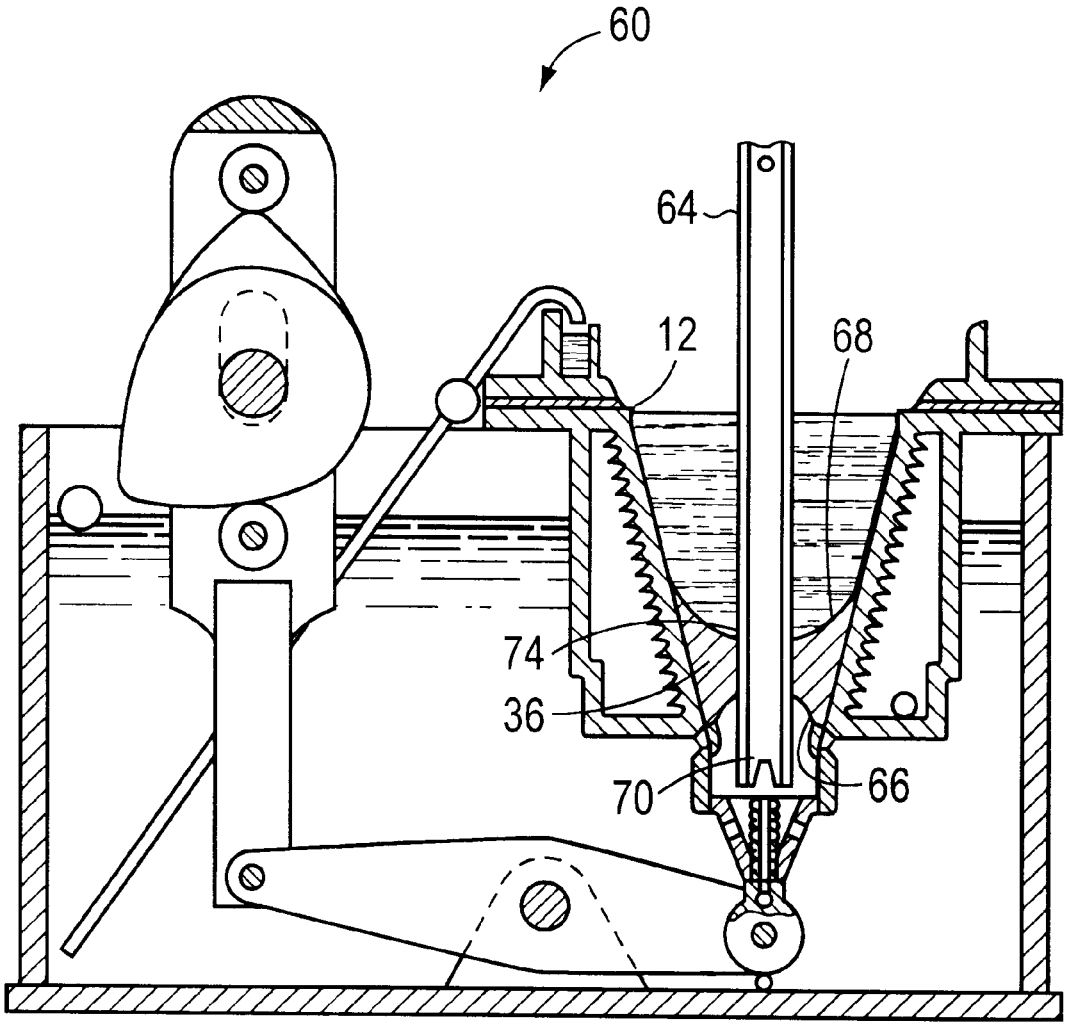
FIG. 3*b* shows the continuous freezing machine of FIG. 3*a* after the removal of the hollow rod.

In FIG. 3*b*, ice core 36 has formed sufficiently to allow ram action to begin. Ram action occurs when approximately two inches (2") in the length of the lower end of tube 64 is surrounded by ice. Tube 64 is then removed. If tube 64 is metal, heating its upper end frees tube 64 without harming ice core 36. If tube 64 is made of a plastic, a gentle but firm rotational force frees tube 64.

Figure 3C:
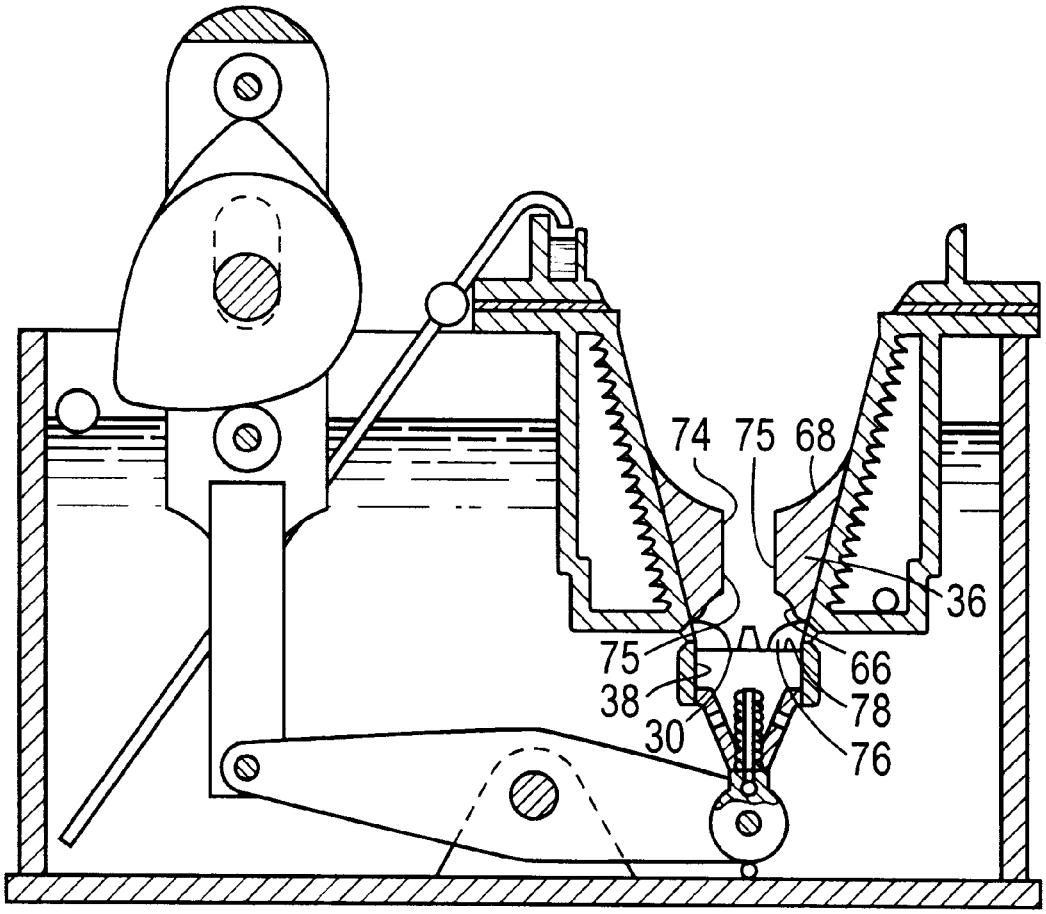
FIG. 3*c* shows the continuous freezing machine of FIG. 3*b* after initiation of ram action.

FIG. 3*c* shows continuous freezing machine 60 as ram action begins. The removal of tube 64 forms vent 74 that extends vertically from bottom surface 66 to top surface 68. As plunger 30 scrapes ice sleeve 40 from inner wall 38, the resulting ice chips 76 are collected on surface 78 of plunger 30 and are pressed against bottom surface 66 of ice core 36 releasing air bubbles. The released air exhausts through vent 74. At this point, the sides of projection member 62 do not contact wall 75 of the vent 74.

Figure 3D:
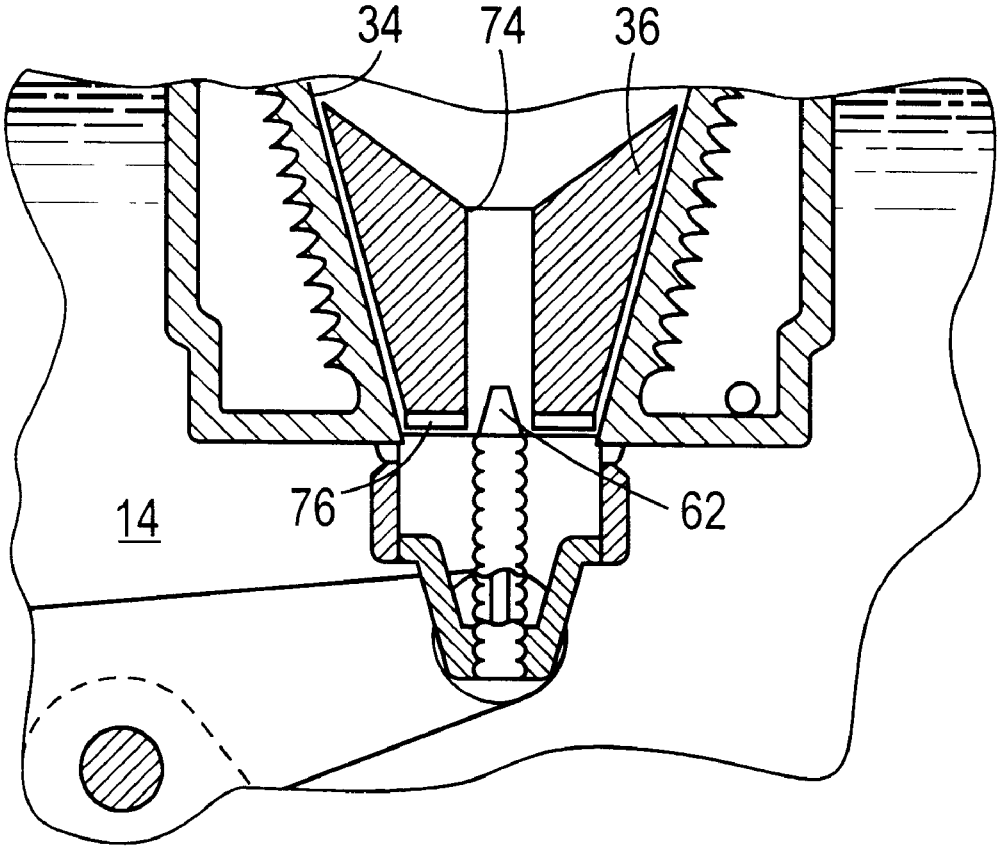
FIG. 3*d* shows an enlargement of a portion of the continuous freezing machine of FIG. 3*c*.

As ram action continues, as shown in FIG. 3*d*, projection member 62 enters vent 74 preventing ice chips 76 from entering and sealing vent 74. Thus, ice chips 76 are added and compressed to ice core 36 without the formation of any air pockets within ice core 36.

When ram 28, plunger 30 and projection member 62 are in their "at-rest" position, they are in thermal communication with water in reservoir 14 which maintain ram 28, plunger 30 and projector member 62 above the freezing temperature. This prevents ice from forming on the surface of projection member 62 as it remains above freezing temperature.

Vent 74 is advantageous in enabling another function to be provided in connection with the ice core that has been formed. Vent 74 can be used to aid in the movement of ice blocks cut from ice core 36.

Figure 4A:
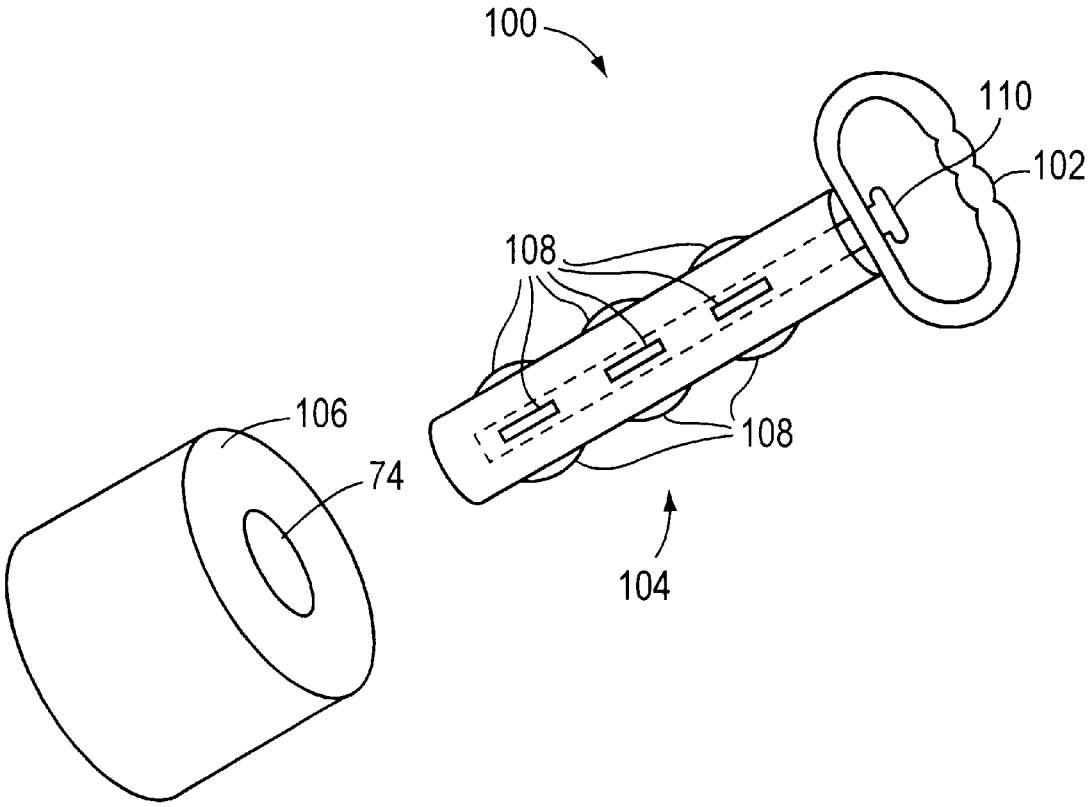
FIG. 4*a* shows a carrier of the present invention that simplifies movement of ice blocks cut from the ice core formed by the machine of FIG. 3.
Figure 4B:
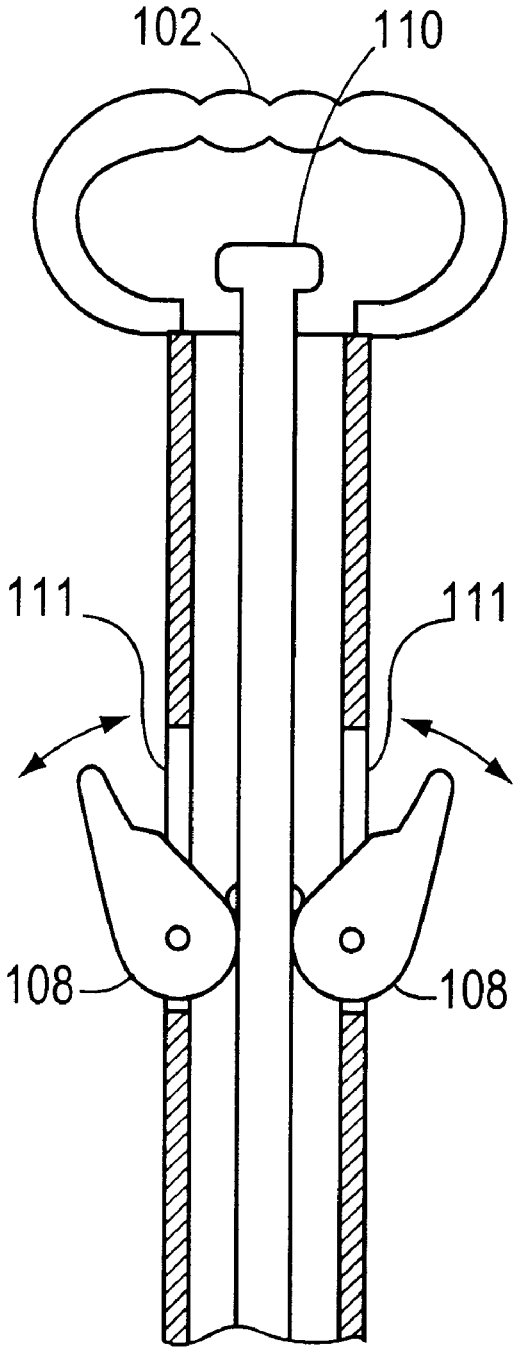
FIG. 4*b* is a sectional detail of the carrier shown in FIG. 4*a*.

Referring to FIG. 4*a*, carrier 100 includes grip 102 and shaft 104 depending from grip 102. Shaft 104 is substantially the same shape and diameter/perimeter dimensions as vent 74 of an ice block 106 formed by continuous freezing machine 60. Shaft 104 includes a series of one-way motion cammed barbs 108 extending therefrom at spaced apart intervals on the shaft. Rod 110 extending through the center of shaft 104 is used to control the motion of cammed barbs 108. As shown in FIG. 4*b* cammed barbs 108 partially fold or pivot into openings 111 provided in shaft 104 when carrier 100 is inserted into vent 74 of ice block 106. Any attempt to remove carrier 100 causes cammed barbs 108 to pivot outwardly away from shaft 104 and grip into ice block 106 without damaging its overall material structure. In this position cammed bar 108 are in contact with rod 110 which prevents cammed barbs 108 from over rotating. The friction occurring when pressing rod 110 downward retracts cammed barbs 108 into shaft 104 allowing removal of carrier 100 from the ice block 106. Small projections 112 can also be provided on rod 110 adjacent and above each cammed barb which, when rod 110 is pressed, cause the retraction of cammed barbs 108 allowing carrier 100 to be removed from the ice block.

Although a preferred embodiment the invention has been described those skilled in the art will recognize modifications can be made without departing from the scope of the invention.

What is claimed:

1. An apparatus for continuously extruding an ice core, comprising:

a freezing cell in which an ice core forms;

a ram and plunger mechanism for lifting said ice core in said freezing cell; and a projection member extending from said plunger adapted to seal one end of a vent, formed between the top and bottom ends of said core, immediately before and during the time said ram and plunger lift said ice core.

2. The apparatus of claim 1 wherein said projection member is substantially vertical.

3. The apparatus of claim 1 wherein said projection member is maintained at a temperature above freezing.

4. The apparatus of claim 1 wherein said projection member is made of a material to having a low affinity for ice.

5. The apparatus of claim 1 including a tube for defining said vent and having an end adapted to form a seal with said projection.

6. A system for continuously extruding an ice core which includes a freezing cell, a ram and a plunger adapted for reciprocating action to lift said ice core within said freezing cell, further comprising:

a projection member extending up from said plunger adapted to seal one end of a vent, formed between the top and bottom ends of said core, during a portion of said reciprocating action of said ram and plunger.

7. The apparatus of claim 6 wherein said seal forms and exists immediately prior to and during the time said plunger lifts said ice core.

8. The apparatus of claim 6 wherein said projection is maintained at a temperature above freezing.

9. The apparatus of claim 6 wherein said projection is made of a material having a low affinity for ice.

10. The apparatus of claim 9 wherein said projection is made of a metal.

11. The apparatus of claim 9 wherein said projection is made of polyvinyl chloride.

12. The apparatus of claim 6 further comprising a member suspended in said freezing cell adapted to form said vent when water is initially drawn into said freezing cell and cooled to form the beginning of said ice core.

13. The apparatus of claim 12 wherein said member is hollow and said projection is adapted to form a substantially water-tight seal with one end of said hollow member.

14. A method of forming an ice core in a freezing cell, comprising the steps of:

placing a lower end of a rod member in said freezing cell and said lower end forming a seal with a bottom portion of said freezing cell;

introducing water into said freezing cell and around said member;

allowing a portion of said water within said freezing cell to freeze into an ice core;

removing said rod member from said ice core thereby forming a vent in said ice core to pass air from below the ice core to above the ice core.

15. The method of claim 14 further comprising:

sealing the lower end of said vent immediately before and during the raising of said ice core, said raising of said ice core creating an annular space between said ice core and said freezing cell;

introducing water into said annular space between said ice core and said freezing cell;

allowing said water in said annular space to freeze.

16. The method of claim 14 wherein said rod member is removed by heating said rod member to free it from said ice mass.

17. The method of claim 16 wherein said rod member is made of a material with a low affinity for ice.

18. The method of claim 17 wherein said rod member is made of a noncorrosive metal.

19. The method of claim 17 wherein said rod member is made of a plastic.

20. A carrier for moving an ice block cut from a ice core having a vent, comprising:

a hand grip;

a hollow shaft mounted on said hand grip substantially the same shape and perimeter dimension as a vent that extends between the top and bottom surfaces of the ice block;

said shaft having a plurality of cammed barbs attached to the perimeter of the shaft, said cammed barbs adapted to allow the insertion of said shaft into said ice block and said cammed barbs adapted to prevent extraction of said shaft from said ice block; and a rod extending through the interior of said shaft in contact with said cammed barbs and adapted to control the position of the cammed barbs.

21. The carrier of claim 20 where in said cammed barbs fold into said shaft when said shaft is inserted into said vent.

22. The carrier of claim 21 wherein said cammed barbs grip said ice block when said shaft is moved in a direction opposite the direction of insertion of said shaft into an ice core.

23. The carrier of claim 22 wherein said rod, when pressed, retracts the cammed barbs to retract allowing removal of the carrier from the ice core.

24. The carrier of claim 23 wherein said rod is provided with projections positioned adjacent to and above each cammed barb, said projections causing the retraction of the cammed barbs when said rod is pressed.

* * * * *

UNITED STATES PATENT AND TRADEMARK OFFICE

CERTIFICATE OF CORRECTION

PATENT NO. : 6,101,817
DATED : August 15, 2000
INVENTOR(S) : John R. Watt

It is certified that error appears in the above-identified patent and that said Letters Patent is hereby corrected as shown below:

Column 7, claims 20 - 24,
Omit in its entirety.

Signed and Sealed this

Second Day of April, 2002

*Attest:*

*Attesting Officer*

JAMES E. ROGAN
*Director of the United States Patent and Trademark Office*